US007032422B2

(12) United States Patent
Hatano

(10) Patent No.: US 7,032,422 B2
(45) Date of Patent: Apr. 25, 2006

(54) PIPE BENDING PROCESSING APPARATUS AND PIPE BENDING PROCESSING METHOD

(75) Inventor: Yasuji Hatano, Tokyo (JP)

(73) Assignee: Calsonic Kansei Corporation, Tokyo (JP)

( * ) Notice: Subject to any disclaimer, the term of this patent is extended or adjusted under 35 U.S.C. 154(b) by 216 days.

(21) Appl. No.: 10/388,222

(22) Filed: Mar. 14, 2003

(65) Prior Publication Data

US 2004/0011106 A1 Jan. 22, 2004

(30) Foreign Application Priority Data

Mar. 15, 2002 (JP) ..... P2002-071153
Jul. 5, 2002 (JP) ..... P2002-196864

(51) Int. Cl.
*B21D 7/025* (2006.01)
*B21D 9/07* (2006.01)

(52) U.S. Cl. ..... 72/150; 72/154

(58) Field of Classification Search ..... 72/149, 72/150, 154, 155
See application file for complete search history.

(56) References Cited

U.S. PATENT DOCUMENTS 2,357,006 A * 8/1944 Johnson ..... 72/155
5,337,590 A * 8/1994 Schuchert et al. ..... 72/157
6,155,091 A * 12/2000 Hayes et al. ..... 72/150

FOREIGN PATENT DOCUMENTS

DE 1 752 566 * 8/1973 ..... 72/154
JP 61-222634 A 10/1986
JP 63-295024 A 12/1988
JP 63-295025 A 12/1988
JP 3-248719 A 11/1991
JP 5096332 4/1993

* cited by examiner

*Primary Examiner*—Lowell A. Larson
(74) *Attorney, Agent, or Firm*—Foley & Lardner LLP

(57) ABSTRACT

A pipe bending processing apparatus includes a drawing and bending section for pressingly contacting a drawing and bending mold, a clamp mold with one end of a pipe P and performing drawing and bending processing, compression bending section for pressingly contacting a chuck with the other end of the pipe and performing compression bending processing, side bending section for pressingly contacting a wiper, and a side bending mold with the side of the pipe and performing side bending processing. The side bending mold provides a stopper 8 which advances and retracts from a pipe pressingly contact surface and engages with the other end of the pipe.

16 Claims, 6 Drawing Sheets

PIPE BENDING PROCESSING APPARATUS AND PIPE BENDING PROCESSING METHOD

The present disclosure relates to the subject matter contained in Japanese Patent Application No. 2002-071153 filed on Mar. 15, 2002, and in Japanese Patent Application No. 2002-196864 filed on Jul. 5, 2002, which are incorporated herein by reference in its entirety.

BACKGROUND OF THE INVENTION

1. Field of the Invention

The present invention relates to a technical-field of a pipe bending processing apparatus and a pipe bending processing method suitable to perform small radius bending processing of a pipe.

2. Description of the Related Art

As the conventional art of this kind, the art described in JP-A-61-222634 (JP-B-2-015291) has been known. This conventional art has a structure as shown in FIG. 10.

As shown in FIG. 10, one end of a pipe P is tightened and fixed by a clamp mold 102 in a drawing and bending mold 101 for performing drawing and bending processing. The drawing and bending mold 101 rotates by a cylinder (not shown) for drawing and bending and performs the drawing and bending processing. The other end of the pipe P is tightened and fixed by a chuck 103 for performing compression bending processing. The chuck 103 moves in a pipe axis direction by a cylinder (not shown) for compression bending and performs the compression bending processing. The side the pipe P is tightened and fixed by a wiper 104 and a side bending mold 105. The side bending mold 105 moves in the pipe axis direction by a cylinder (not shown) for side bending and performs side bending processing. Incidentally, numeral 106 is a mandrel and is fixed in the top of a mandrel shaft 107.

In the structure, the drawing and bending mold 101 and the chuck 103 are actuated to perform the drawing and bending processing and the compression bending processing and simultaneously the side bending mold 105 is actuated to perform the side bending processing and thereby, bending processing of a small radius of the pipe can be performed while suppressing a reduction in wall thickness occurring in the back side of a bending processing part.

However, in the conventional art described above, the wiper 104 is located in a pipe compression direction of the chuck 103 for pressing the other end of the pipe P, so that the chuck 103 can pressurize the pipe only until just before interfering with the wiper 104. Therefore, as shown in FIG. 11, an extrusion margin 10 must be left for the other end of the pipe P, so that there were problems that a step of cutting an unnecessary portion of this extrusion margin 10 after processing is required and also yield is low since the cut portion becomes waste.

SUMMARY OF THE INVENTION

It is therefore an object of the invention to provide a pipe bending processing apparatus and a pipe bending processing method capable of improving a yield rate and performing small radius bending processing of a pipe without setting an extrusion margin in the end of the pipe.

In order to achieve the object, according to a first aspect of the invention, there is provided a pipe bending processing apparatus having: a drawing and bending section for pressingly contacting a drawing and bending mold with one end of a pipe and performing drawing and bending processing; a side bending section for pressingly contacting a side bending mold with the side of the pipe and performing side bending processing; and a stopper provided at the side bending mold and protrudes from a pipe contacting surface of the side bending mold and engages with other end of the pipe.

According to the first aspect of the invention, the side bending mold provides a stopper which protrudes to the pipe side. Therefore, in the case that a bending processing part of a pipe to be processed is near to the end and the compression bending mold interferes with the side bending mold when compression bending processing and side bending processing are performed with respect to the pipe, the stopper of the side bending mold is engaged with the end of the pipe and the side bending mold and the drawing and bending mold are actuated and thereby the stopper pressurizes the end of the pipe in a movement direction of the side bending mold, so that the side bending processing and the compression bending processing are simultaneously performed by the side bending mold.

Therefore, since there is no need to set an extrusion margin for avoiding interference between the compression bending mold and the side bending mold in the end of the pipe, a yield rate can be improved and also a step of cutting an unnecessary portion of the extrusion margin becomes unnecessary, so that effect capable of reducing the number of man-hours can be obtained.

According to a second aspect of the invention, there is provided a pipe bending processing method using a pipe bending processing apparatus in the first aspect of the invention, having: contacting the drawing and bending mold pressingly with one end of the pipe; contacting the side bending mold pressingly with the side of the pipe; engaging the stopper with the other end of the pipe; and moving the drawing and bending mold and the side bending mold in a processing direction to perform bending processing of the pipe.

According to the second aspect of the invention, since there is no need to set an extrusion margin for avoiding interference between the compression bending mold and the side bending mold in the end of the pipe, a yield rate can be improved. Further, a step of cutting an unnecessary portion of the extrusion margin becomes unnecessary, so that the number of man-hours can be reduced.

Furthermore, a side bending mold in which a plurality of stoppers are provided is used and when the side bending mold is pressingly contacted with a pipe, a pipe axial position of the side bending mold is set according to a length of the pipe and thereby, for pipes with the same diameter, processing can be performed continuously without replacing the side bending mold. Therefore, further improvements in material yield and workability can be achieved.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Referring now to the accompanying drawings, there is shown a preferred embodiment of the invention.

First Embodiment

Figure 1:
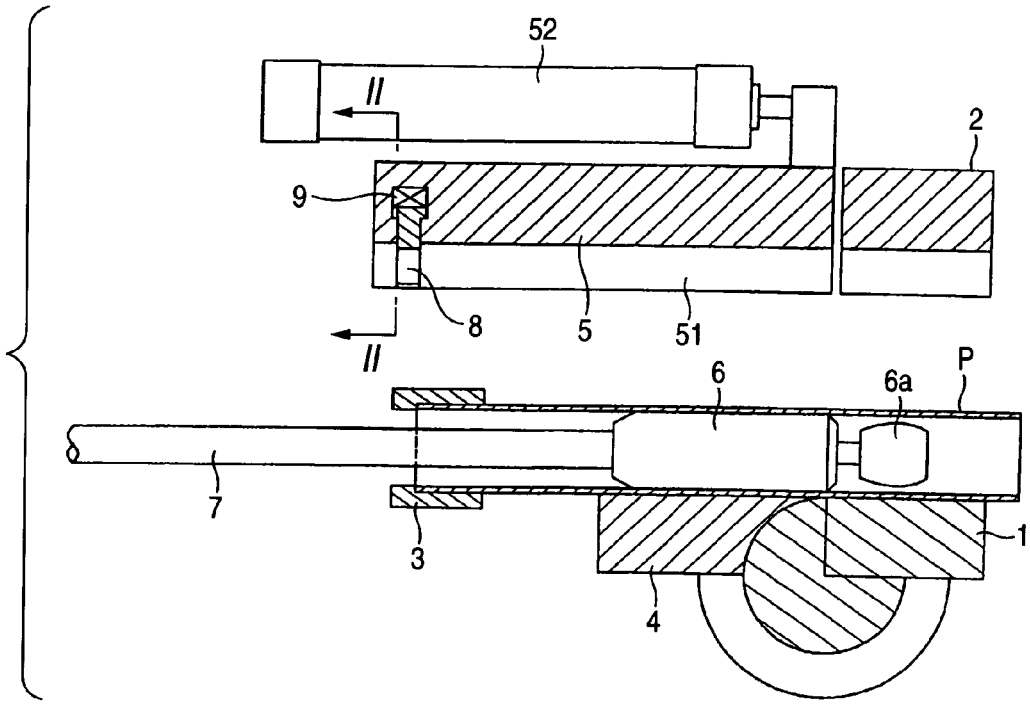
FIG. 1 is a sectional view showing a pipe bending processing apparatus of a first embodiment.

FIG. 1 is a sectional view showing a first embodiment of a pipe bending processing apparatus of the invention.

In FIG. 1, P is a pipe, numeral 1 is a drawing and bending mold, numeral 2 is a clamp mold, numeral 3 is a chuck, numeral 4 is a wiper, numeral 5 is a side bending mold, and numeral 6 is a mandrel.

The drawing and bending mold 1 tightens and fixes one end of the pipe P along with the clamp mold 2. The drawing and bending mold 1 rotates by a cylinder (not shown) for drawing and bending and performs drawing and bending processing of the pipe P.

The chuck 3 tightens and fixes the other end of the pipe P. The chuck 3 moves in a pipe axis direction by a cylinder (not shown) for compression bending and performs compression bending processing of the pipe P.

The wiper 4 and the side bending mold 5 tighten and fix the side of the pipe P. The wiper 4 is fixed, and the side bending mold 5 moves in the pipe axis direction by a cylinder 52 for side bending and performs side bending processing of the pipe P.

Incidentally, the side bending mold 5 is preferably moved in the pipe axis direction with a movement speed and a movement pressure of the side bending mold 5 set arbitrarily according to a diameter, a plate thickness and bending R of the pipe P.

Figure 2:
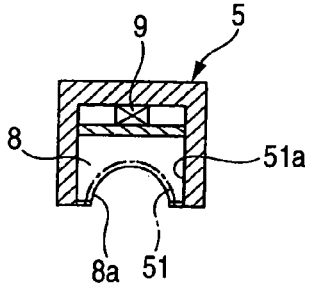
FIG. 2 is a sectional view taken on line II—II of FIG. 1.

A stopper 8 is provided in a pipe pressingly contact surface 51 in the vicinity of the back end of the side bending mold 5. The stopper 8 is provided retractably by a spring 9 from a recess part 51*a* formed in the pipe pressingly contact surface 51 to the side of the pipe pressingly contact surface 51 as shown in FIG. 2. The top of this stopper 8 is set so that a notch part 8*a* with an inferior arc shape is formed along an end face shape of the pipe P and the opening edge of this notch part 8*a* engages with the edge of the pipe P.

Incidentally, the cylinder for drawing and bending, the cylinder for compression bending and the cylinder 52 for side bending are simultaneously controlled by a controller (not shown).

The mandrel 6 is means for suppressing occurrence of ovalization, buckling or wrinkles of a bending processing part of the pipe P, and is formed so that a top part 6*a* can fold by a predetermined angle in a bending direction of the pipe P. This mandrel 6 is fixed in a mandrel shaft 7 and is inserted into the inside of the pipe P from the other end of the pipe P.

The pipe bending apparatus will be acted as follows when a bending processing part of the pipe P is set near to the end of the pipe P.

First, as shown in FIG. 1, in a state in which the clamp mold 2 and the side bending mold 5 are separated from the pipe P, the end of the pipe P is grasped by the chuck 3 and the pipe P is advanced to a predetermined position, that is, until the end of the pipe P is positioned in the front of a pipe compression bending direction than the stopper 8 of the side bending mold 5. At this time, as shown in FIG. 2, the top of this stopper 8 protrudes from the pipe pressingly contact surface 51 to the side of the pipe P by a biasing force of the spring 9.

Figure 3:
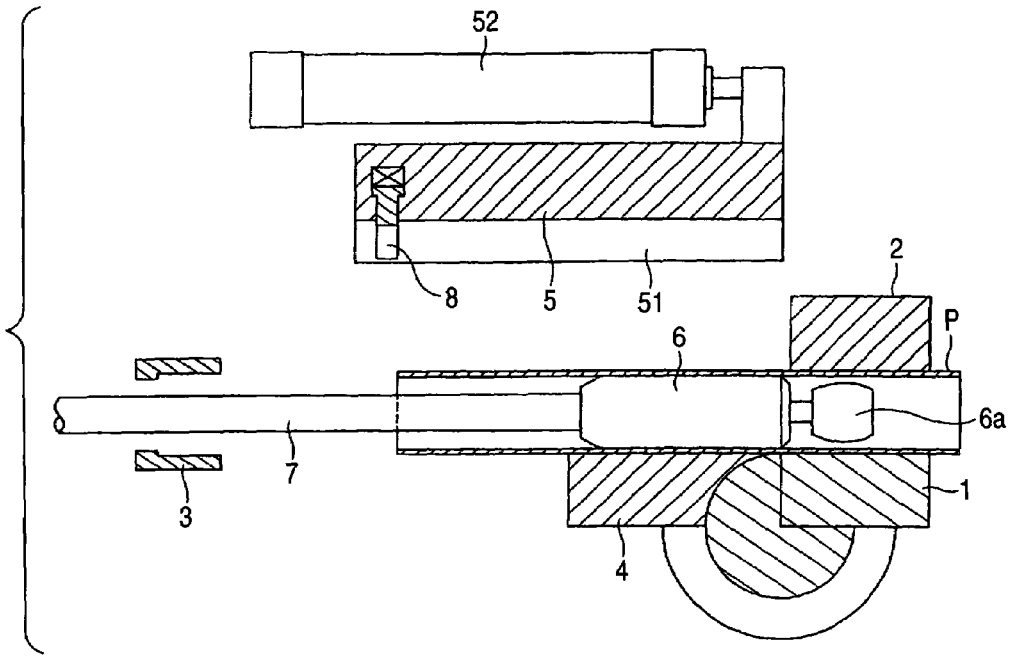
FIG. 3 is a sectional view of the pipe bending processing apparatus showing action of the first embodiment.
Figure 4:
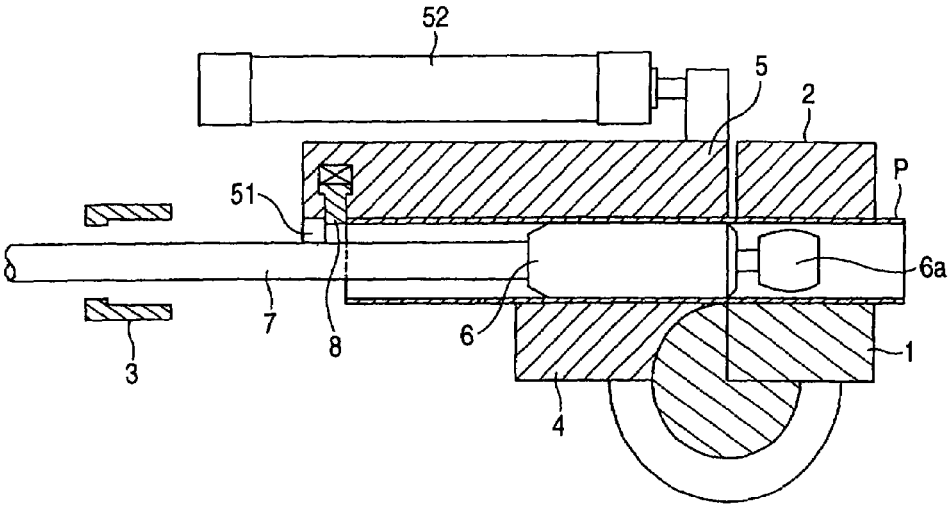
FIG. 4 is a sectional view of the pipe bending processing apparatus showing the action of the first embodiment.

Subsequently, as shown in FIG. 3, after clamping the pipe P by the clamp mold 2, the chuck 3 is separated from the end of the pipe Pandas shown in FIG. 4, the side bending mold 5 is pressingly contacted with the pipe P and the other end of the pipe P is grasped by the drawing and bending mold 1 and the clamp mold 2 and also the side of the pipe P is pressingly contacted by the wiper 4 and the side bending mold 5.

Figure 5:
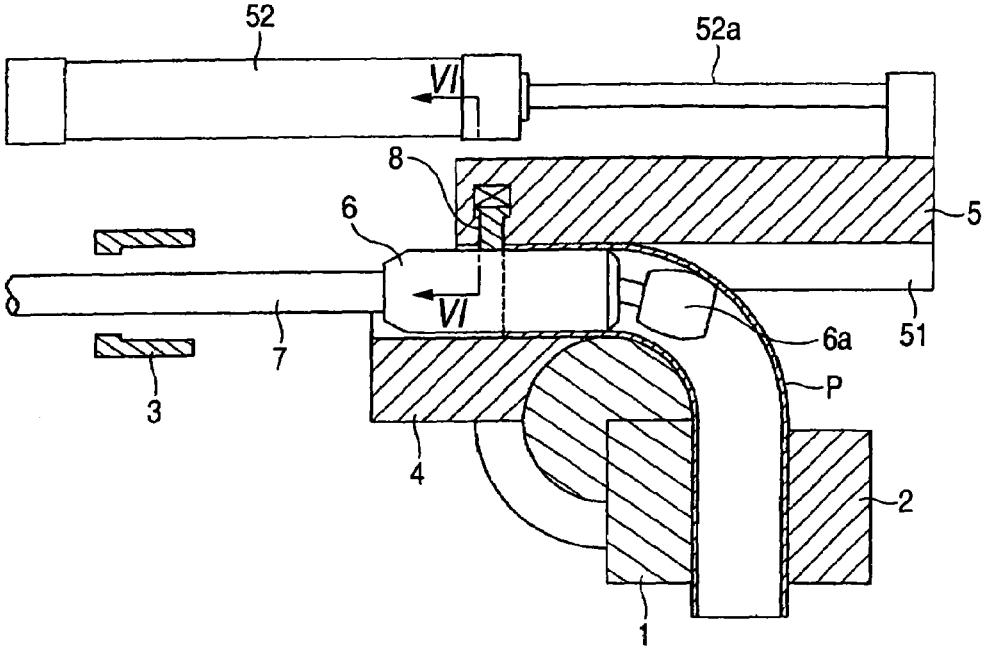
FIG. 5 is a sectional view of the pipe bending processing apparatus showing the action of the first embodiment.

Next, as shown in FIG. 5, while the drawing and bending mold 1 is rotated and driven by the cylinder (not shown), a rod 52*a* of the cylinder 52 for side bending is extended and the side bending mold 5 is advanced to perform drawing and bending processing and side bending processing with respect to the pipe P.

Figure 6:
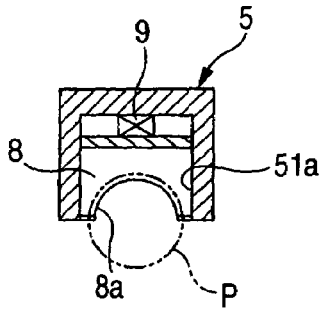
FIG. 6 is a sectional view taken on line VI—VI of FIG. 5.

At this time, as shown in FIG. 6, the opening edge of the notch part 8a of the stopper 8 engages with the edge of the pipe P at the opposite side of the bending direction and pressurize in a movement direction of the side bending mold 5. Therefore, compression bending processing is performed together with the drawing and bending processing and the side bending processing with respect to the pipe P.

Incidentally, in bending processing of the pipe P, a reduction in wall thickness occurs at the bending processing part in the opposite side of a bending processing direction, so that suppression of the reduction in wall thickness is achieved by pressing the pipe P at the opposite side of the bending processing direction by means of the stopper 8.

Also, since it is set so that the notch part 8*a* of the stopper 8 is formed into an inferior arc shape and its opening edge engages with only the edge of the processing part back side of the pipe P, there is no interference with the mandrel 6 of the inside of the pipe P during the compression bending processing.

The pipe bending apparatus will be acted as follows when a bending processing part of the pipe P is set distant from the end of the pipe P.

Figure 7:
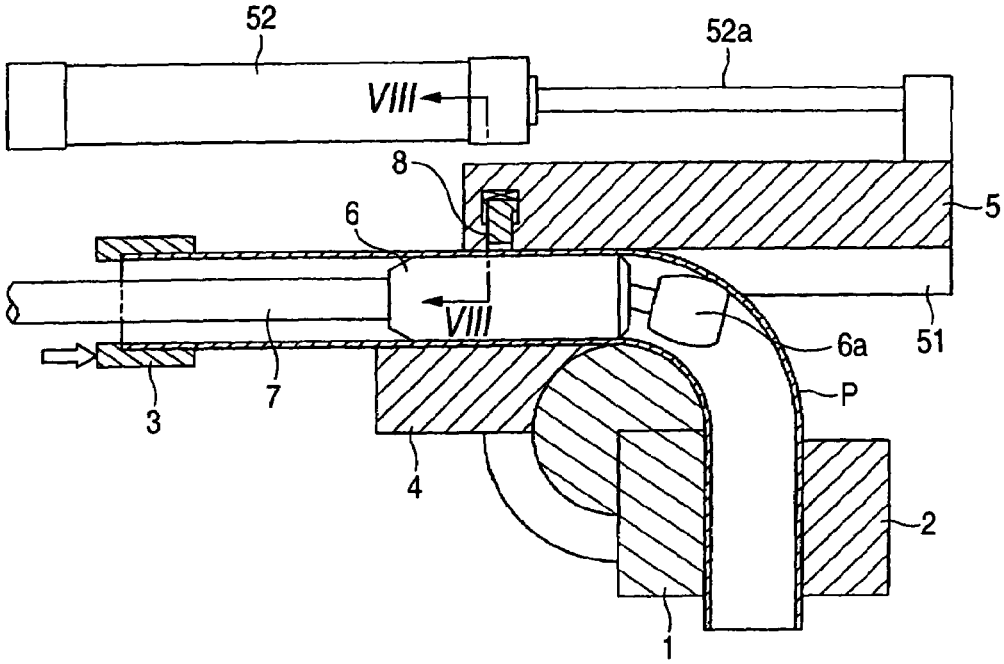
FIG. 7 is a sectional view of the pipe bending processing apparatus showing the action of the first embodiment.
Figure 8:
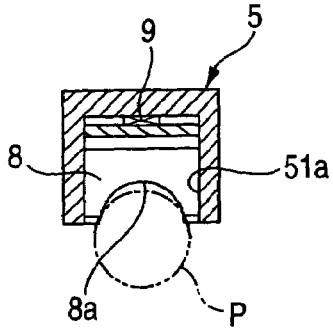
FIG. 8 is a sectional view taken on line VIII—VIII of FIG. 7.

In this case, there is no need to consider interference between the chuck 3 and the wiper 4, so that the chuck 3 is simultaneously driven in addition to the drawing and bending mold 1 and the side bending mold 5 to perform drawing and bending processing, side bending processing and compression bending processing as shown in FIG. 7.

At this time, the stopper 8 is pressed by the side of the pipe P and becomes a state of being stored from the pipe pressingly contact surface 51 to the recess part 51*a*.

As described above, in the pipe bending processing apparatus of the first embodiment, there is no need to set an extrusion margin for avoiding interference between the chuck 3 and the wiper 4 in the end of the pipe P. Therefore, a yield rate can be improved and also a step of cutting an unnecessary portion of the extrusion margin becomes unnecessary, so that the number of man-hours can be reduced.

Also, since the stopper 8 engages with only the edge of the bending processing part back side of the pipe P, the stopper 8 does not interfere with the mandrel 6 and the compression bending processing of the pipe P can be fully performed to the vicinity of the bending processing part.

Furthermore, since the stopper 8 is set so as to advance and retract from the pipe pressingly contact surface 51 by the spring 9, when the compression bending processing is performed using the chuck 3, the stopper 8 abuts on the side of the pipe P to be stored automatically only by pressingly contacting the side bending mold 5 with the side of the pipe. Therefore, there is no need for an actuator for advancing and retracting the stopper 8, so that it can be constructed at low cost.

Second Embodiment

Figure 9:
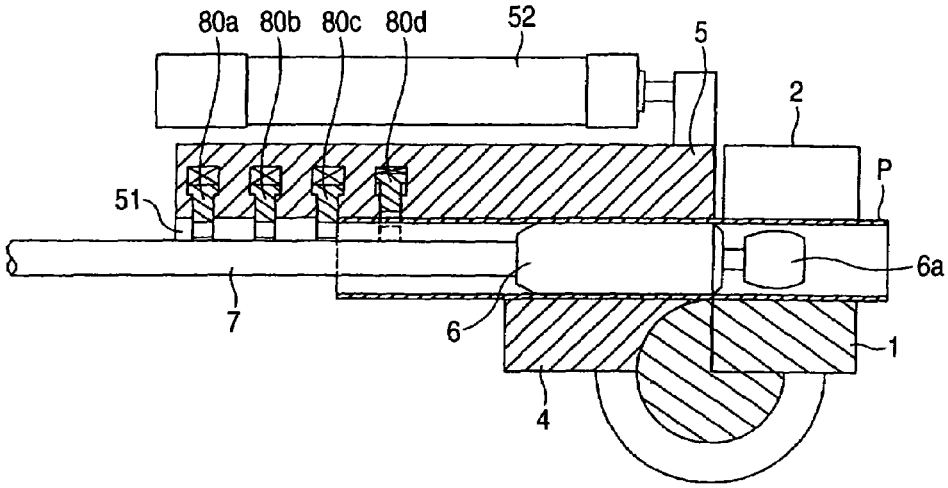
FIG. 9 is a sectional view showing a pipe bending processing apparatus of a second embodiment.
Figure 10:
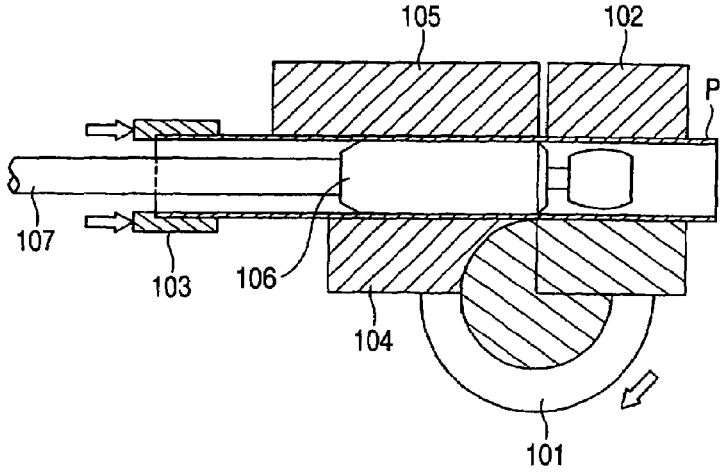
FIG. 10 is a sectional view showing a conventional pipe bending processing apparatus.
Figure 11:
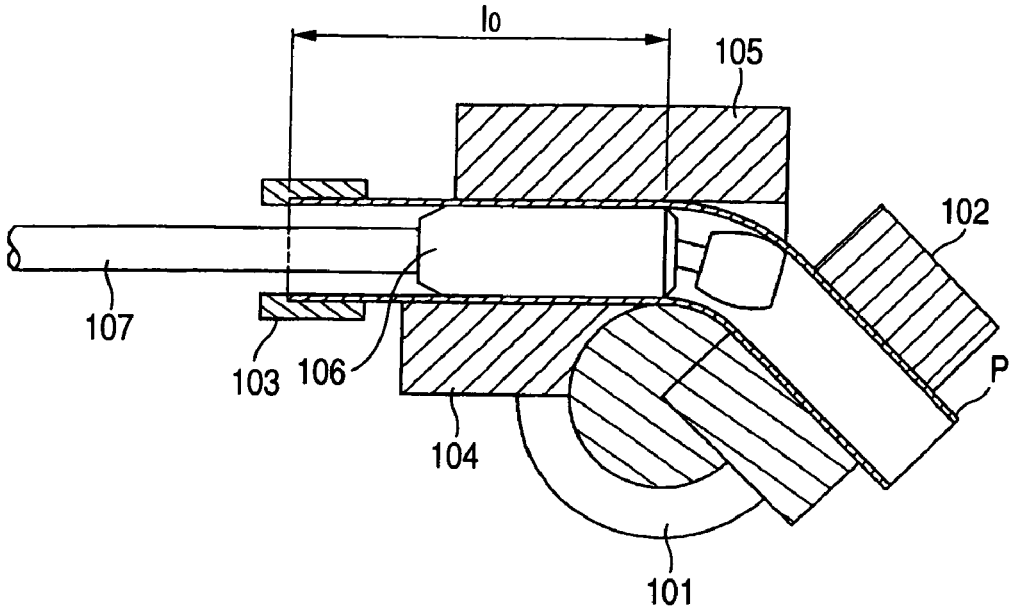
FIG. 11 is a sectional view showing action of the conventional pipe bending processing apparatus.

FIG. 9 is a sectional view showing a second embodiment of a pipe bending processing apparatus of the invention. Incidentally, the second embodiment differs from the first embodiment in that a plurality of stoppers are provided in a length direction of a pipe.

That is, a pipe pressingly contact surface 51 in the vicinity of the back end of the side bending mold 5 is provided with stoppers 80*a* to 80*d*. As a spacing of these stoppers 80*a* to 80*d*, a spacing in which a gap between the side bending mold 5 and a clamp 2 does not influence bending, for example, the order of 10 mm to 30 mm is suitable.

The side bending mold 5 can adjust a pipe pressingly contact position according to a length of a pipe P by a cylinder 52 for side bending in which NC (numerical control) is performed. That is, it is set so that any one of the stoppers 80*a* to 80*d* aligns with an end position of the pipe P by inputting a length of the pipe P to be processed to an NC machine previously.

As described above, in the pipe bending processing apparatus of the second embodiment, advantage described as follows can be obtained in addition to the first embodiment.

In pipes with the same diameter, the side bending mold can be shared, so that processing can be performed continuously without replacing the side bending mold 5 every time the length of the pipe to be processed varies. In addition, there is no need to prepare the side bending mold every the length of the pipe, so that cost cutting can be achieved.

Other Embodiments

Although the embodiments of the invention have been described above, a specific structure of the invention is not limited to the embodiments and even when a change in design without departing from the subject matter of the invention is made, it is included in the invention.

For example, in the first embodiment, the example in which the stopper 8 is advanced and retracted by the biasing force of the spring 9 has been shown, but biasing means of the stopper 8 is arbitrary. Also, it may be a structure in which the stopper 8 is advanced and retracted using an actuator rather than the biasing means.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A pipe bending processing apparatus comprising:

a drawing and bending section for pressingly contacting a drawing and bending mold with one end of a pipe and performing drawing and bending processing;

a side bending section for pressingly contacting a side bending mold with the side of the pipe and performing side bending processing;

a stopper provided at the side bending mold and protruding from a pipe contacting surface of the side bending mold and engagable with an other end of the pipe, wherein the stopper is configured to be retractable into the pipe contacting surface of the side bending mold; and a compression bending section, separate from the stopper, for pressingly contacting a compression bending mold with the other end of the pipe and performing compression bending processing.

2. The pipe bending processing apparatus as claimed in claim 1, wherein at least two stoppers are provided at the side bending mold along a length direction of the pipe.

3. The pipe bending processing apparatus as claimed in claim 1, wherein the stopper is provided at a side opposite to the bending direction.

4. The pipe bending processing apparatus of claim 1, further comprising a mandrel that extends into the pipe during the drawing and bending processing.

5. The pipe bending processing apparatus of claim 4, wherein the mandrel comprises a top part configured to fold by a predetermined angle in a bending direction of the pipe.

6. The pipe bending processing apparatus of claim 1, wherein the compression bending section comprises a chuck, wherein, during the drawing and bending processing, either the chuck or the stopper engages to hold the pipe.

7. The pipe bending processing apparatus of claim 1, wherein the side bending section comprises the side bending mold and a wiper, for pressingly contacting the pipe between the side bending mold and the wiper.

8. A pipe bending processing method using a pipe bending processing apparatus as claimed in claim 7, comprising:

contacting the drawing and bending mold pressingly with one end of the pipe;

contacting the side bending mold and fixed wiper pressingly with the side of the pipe;

engaging the stopper with the other end of the pipe; and moving the drawing and bending mold and the side bending mold in a processing direction to perform bending processing of the pipe.

9. The pipe bending processing method as claimed in claim 8, wherein the side bending mold has a plurality of stoppers provided along a length direction of the pipe, wherein when the side bending mold is pressingly contacted with the side of the pipe, a pipe axial position of the side bending mold is set according to a length of the pipe so that a respective one of the plurality of stoppers aligns with a position of the other end of the pipe.

10. A pipe bending processing apparatus comprising:

a drawing and bending section for pressingly contacting a drawing and bending mold with one end of a pipe and performing drawing and bending processing;

a side bending section, comprising a side bending mold and a wiper, for pressingly contacting the pipe between the side bending mold and the wiper and performing side bending processing; and a stopper provided at the side bending mold and protruding from a pipe contacting surface of the side bending mold and engagable with an other end of the pipe, wherein the stopper is configured to be retractable into the pipe contacting surface of the side bending mold, wherein the stopper has a notch part with an inferior arc shape formed along an end face shape of the pipe; and an edge of the notch part engages with an edge of the pipe.

11. The pipe bending processing apparatus of claim 10, further comprising a mandrel that extends into the pipe during the drawing and bending processing.

12. The pipe bending processing apparatus of claim 11, wherein the mandrel comprises a top part configured to fold by a predetermined angle in a bending direction of the pipe.

13. A pipe bending processing apparatus comprising:

a drawing and bending section for pressingly contacting a drawing and bending mold with one end of a pipe and performing drawing and bending processing;

a side bending section, comprising a side bending mold and a wiper, for pressingly contacting the pipe between the side bending mold and the wiper and performing side bending processing; and a stopper provided at the side bending mold and protruding from a pipe contacting surface of the side bending mold and engagable with an other end of the pipe, wherein the stopper is configured to be retractable into the pipe contacting surface of the side bending mold.

14. A pipe bending processing apparatus comprising:

a drawing and bending section for pressingly contacting a drawing and bending mold with one end of a pipe and performing drawing and bending processing;

a side bending section for pressingly contacting a side bending mold with the side of the pipe and performing side bending processing;

a stopper provided at the side bending mold and protruding from a pipe contacting surface of the side bending mold and engagable with an other end of the pipe, the stopper being retractable into the pipe contacting surface of the side bending mold; and a biasing part for biasing the stopper in direction to the pipe.

15. The pipe bending processing apparatus of claim 14, wherein the biasing part is a spring.

16. The pipe bending processing apparatus of claim 14, wherein the stopper has a notch part with an inferior arc shape formed along an end face shape of the pipe; and an edge of the notch part engages with an edge of the pipe.

* * * * *